US009216342B1

(12) United States Patent
Evans

(10) Patent No.: US 9,216,342 B1
(45) Date of Patent: Dec. 22, 2015

(54) GRIP-IT GOLF METHOD AND SYSTEM

(71) Applicant: Larry J. Evans, Dade City, FL (US)

(72) Inventor: Larry J. Evans, Dade City, FL (US)

( * ) Notice: Subject to any disclaimer, the term of this patent is extended or adjusted under 35 U.S.C. 154(b) by 0 days.

(21) Appl. No.: 14/679,125

(22) Filed: Apr. 6, 2015

Related U.S. Application Data

(63) Continuation-in-part of application No. 14/568,616, filed on Dec. 12, 2014, which is a continuation-in-part of application No. 14/154,794, filed on Jan. 14, 2014, now abandoned, which is a continuation-in-part of application No. 13/943,013, filed on Jul. 16, 2013, now abandoned, which is a continuation-in-part of application No. 13/897,376, filed on May 18, 2013, now Pat. No. 8,701,216, which is a continuation-in-part of application No. 13/408,242, filed on Feb. 29, 2012, now abandoned.

(51) Int. Cl.

| | |
|---|---|
| ***A63B 71/00*** | (2006.01) |
| ***A63B 71/14*** | (2006.01) |
| ***A63B 55/00*** | (2015.01) |
| ***A41D 19/00*** | (2006.01) |

(52) U.S. Cl.
CPC ..... *A63B 71/0036* (2013.01); *A41D 19/0037* (2013.01); *A63B 55/008* (2013.01); *A63B 71/146* (2013.01)

(58) Field of Classification Search
CPC ..... A63B 71/146; A63B 71/0036; A63B 55/008; A41D 19/0034; A41D 19/0037; A41D 19/0041
USPC ..... 2/161.2, 161.3, 161.4, 912, 917, 910
See application file for complete search history.

(56) References Cited

U.S. PATENT DOCUMENTS

| | | | | |
|---|---|---|---|---|
| 3,368,811 | A * | 2/1968 | Finney | 473/300 |
| 3,428,962 | A * | 2/1969 | Slimovitz | 2/48 |
| 4,403,366 | A * | 9/1983 | Lucke | 15/209.1 |
| 5,054,127 | A * | 10/1991 | Zevchak | 2/247 |
| 5,177,881 | A * | 1/1993 | Moore | 34/239 |
| 6,115,872 | A * | 9/2000 | Welsh | 15/209.1 |
| 6,499,227 | B1 * | 12/2002 | Jacobson | 34/106 |
| 6,546,599 | B2 * | 4/2003 | Pelt et al. | 24/3.1 |
| 6,694,575 | B1 * | 2/2004 | Martin | 24/306 |
| D532,606 | S * | 11/2006 | Ogonosky | D3/329 |
| 8,032,951 | B1 * | 10/2011 | Nestberg et al. | 2/247 |
| 2002/0138953 | A1 * | 10/2002 | Passafiume | 24/306 |
| 2005/0120579 | A1 * | 6/2005 | Nicholson | 34/106 |
| 2006/0086629 | A1 * | 4/2006 | Cacioppo | 206/289 |
| 2007/0267454 | A1 * | 11/2007 | Baiz | 224/901.8 |
| 2008/0083131 | A1 * | 4/2008 | Wess | 34/239 |
| 2009/0082126 | A1 * | 3/2009 | Harrison | 473/282 |
| 2010/0064485 | A1 * | 3/2010 | Blevins | 24/306 |

* cited by examiner

*Primary Examiner* — Danny Worrell

(57) ABSTRACT

A grip-it golf system for releasably supporting a golf glove and for maintaining the golf glove in a readily accessible location includes the golf glove, a supporting member, a connector, and a female snap on the interior surface of the connector. The method includes releasably coupling the female snap of the connector to the male snap of the golf bag and releasable coupling the female loop fastener of the glove to the male hook fastener of the connector so that the weight of the connector will hold the glove against the golf bag elevationally beneath the coupled male and female snaps for securement purposes and for drying when the golf bag, connector, and golf glove are moving, as on a golf cart.

4 Claims, 8 Drawing Sheets

FIG. 5
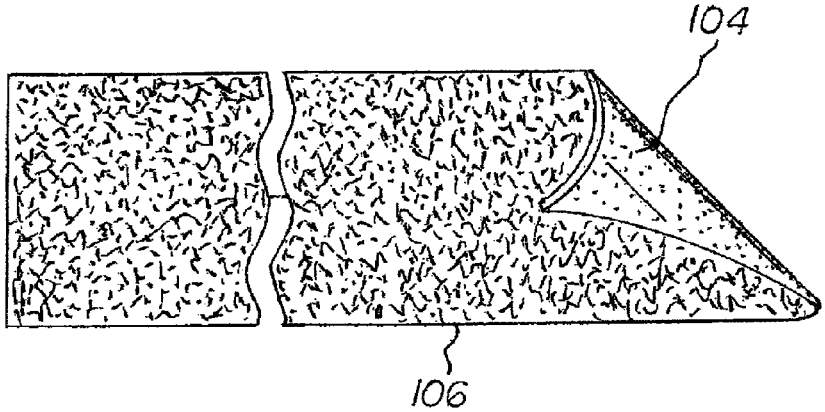
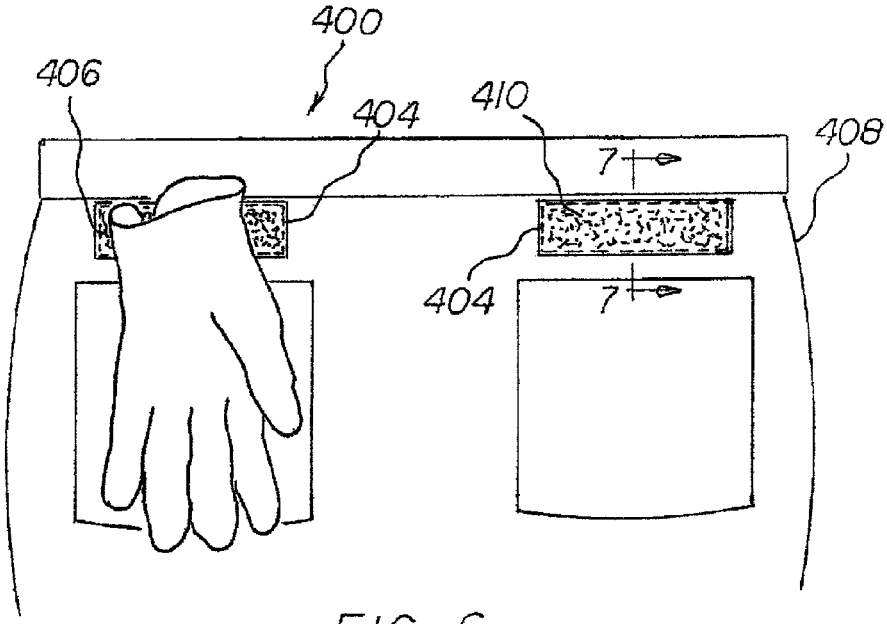
FIG. 6

FIG. 7
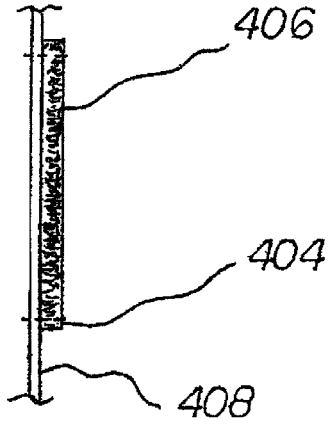
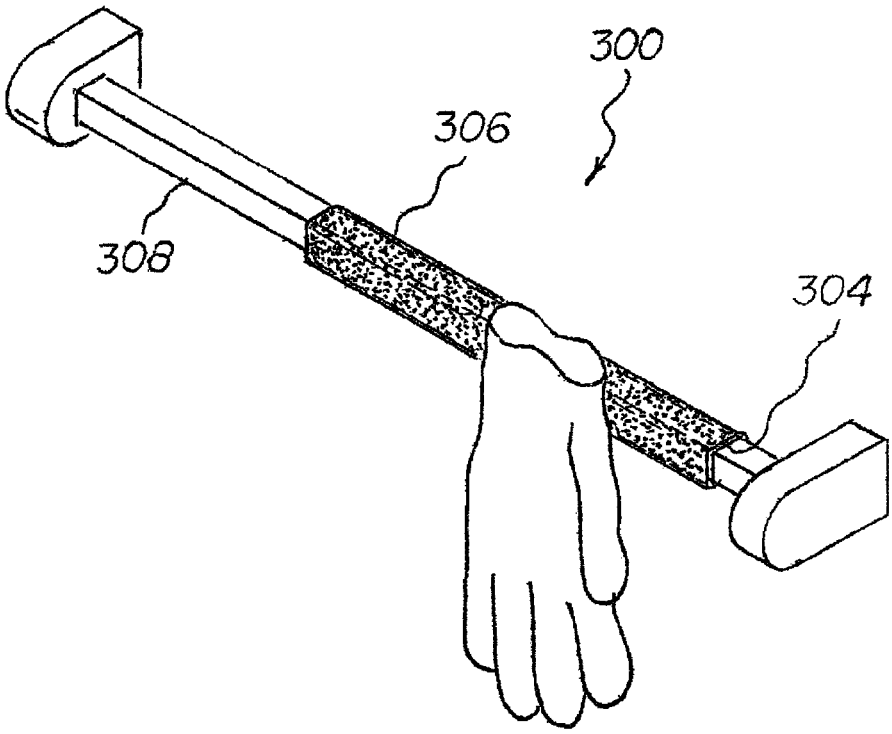
FIG. 8

FIG. 9
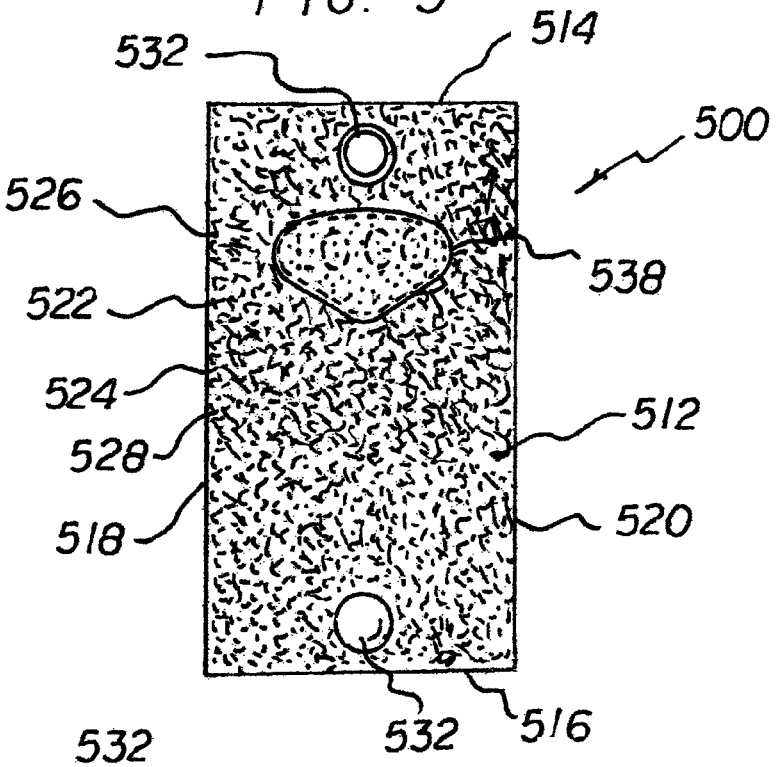
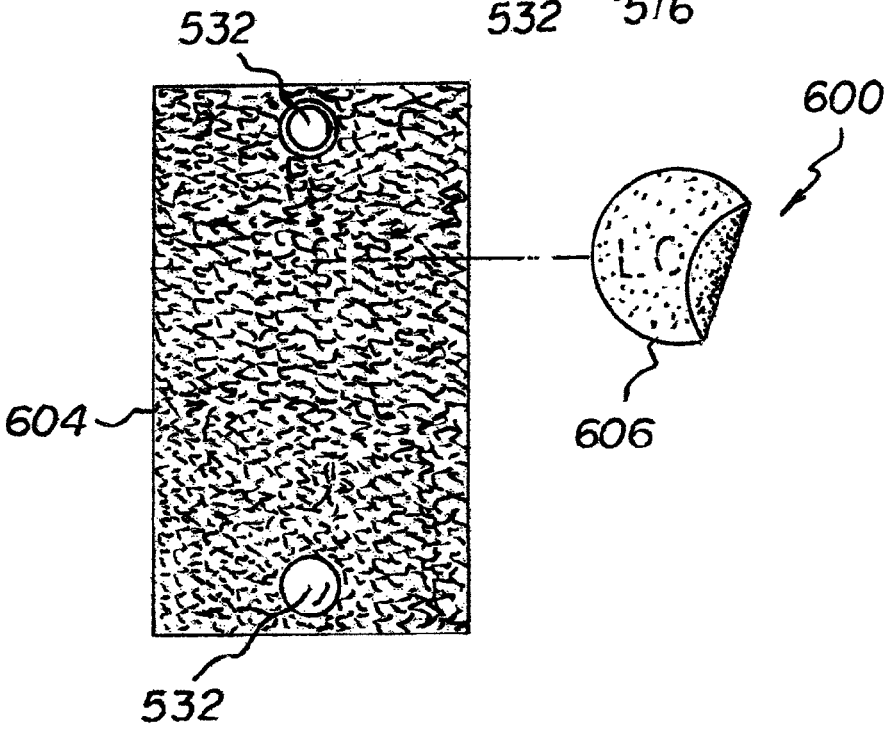
FIG. 10

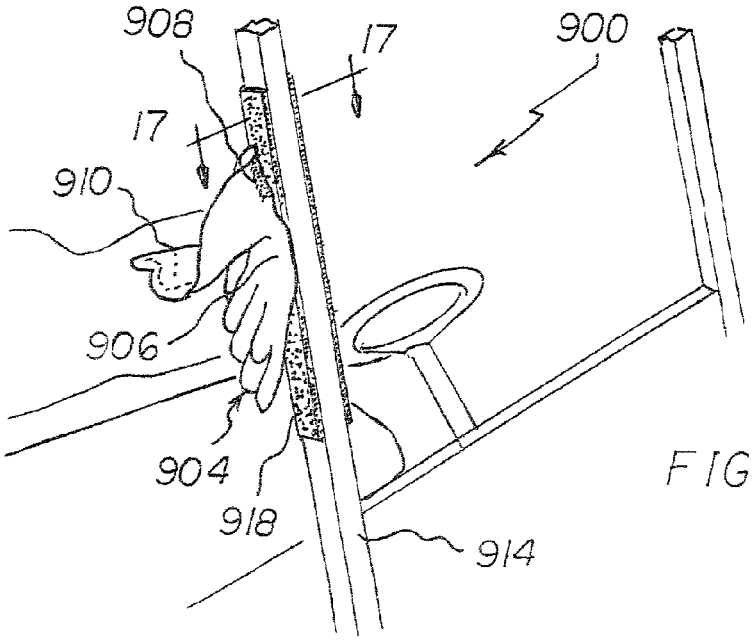
FIG. 16
FIG. 17
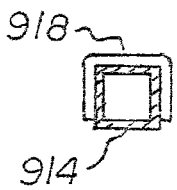
FIG. 18
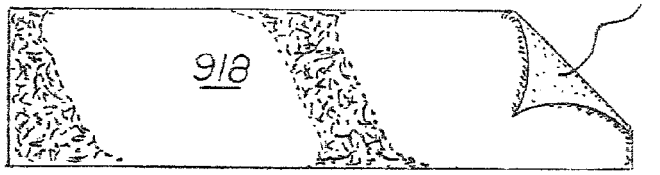
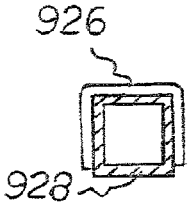
FIG. 19
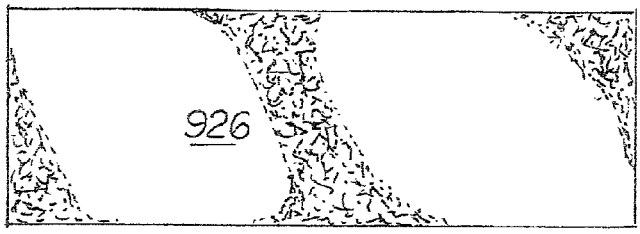
FIG. 20

GRIP-IT GOLF METHOD AND SYSTEM

RELATED APPLICATION

The present invention is a continuation-in-part of pending U.S. patent application Ser. No. 14/568,616 filed Dec. 12, 2014 entitled Grip-It Golf Method which is, in turn, a continuation-in-part of abandoned U.S. patent application Ser. No. 14/154,794 filed Jan. 14, 2014 entitled Grip-It Golf System which is, in turn, a continuation-in-part of abandoned U.S. patent application Ser. No. 13/943,013 filed Jul. 16, 2013 entitled Grip-It Golf System which is in turn a continuation-in-part of U.S. patent application Ser. No. 13/897,376 filed May 18, 2013 entitled Grip-It Golf System which issued Apr. 22, 2014 as U.S. Pat. No. 8,701,216 which is, in turn a continuation-in-part of abandoned U.S. patent application Ser. No. 13/408,242 filed Feb. 29, 2012 entitled Grip-It Golf System, the subject matter of which applications is incorporated herein by reference.

BACKGROUND OF THE INVENTION

Field of the Invention

The present invention relates to a grip-it golf method and system and more particularly pertains to releasably supporting a golf glove and for maintaining the golf glove in a readily accessible location, the supporting and the maintaining being done in a safe, convenient and economical manner.

SUMMARY OF THE INVENTION

In view of the disadvantages inherent in the known types of golf systems of known designs and configurations now present in the prior art, the present invention provides an improved grip-it golf method and system. As such, the general purpose of the present invention, which will be described subsequently in greater detail, is to provide a new and improved grip-it golf method and system which has all the advantages of the prior art and none of the disadvantages.

To attain this, the present invention essentially comprises a grip-it golf method and system for releasably supporting a golf glove and for maintaining the golf glove in a readily accessible location, the method including the steps of providing a connector, a golf cart and the golf glove, then coupling the connector to the golf cart and finally coupling at least one golf glove to the connector.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved grip-it golf method and system which has all of the advantages of the prior art golf systems of known designs and configurations and none of the disadvantages.

It is another object of the present invention to provide a new and improved grip-it golf method and system which may be easily and efficiently manufactured and marketed.

It is further object of the present invention to provide a new and improved grip-it golf method and system which is of durable and reliable constructions.

An even further object of the present invention is to provide a new and improved grip-it golf method and system which is susceptible of a low cost of manufacture with regard to both materials and labor, and which accordingly is then susceptible of low prices of sale to the consuming public, thereby making such grip-it golf method and system economically available to the buying public.

Lastly, it is an object of the present invention to provide a grip-it golf method and system for releasably supporting a golf glove and for maintaining the golf glove in a readily accessible location, the supporting and the maintaining being done in a safe, convenient, and economical manner.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIGS. 3, 4 and 5 are perspective illustrations of alternate embodiments, adhesive embodiments, of the invention.

FIG. 6 is a perspective illustration of another alternate embodiment, a stitched embodiment, of the invention.

FIG. 7 is a cross sectional view taken along line 7-7 of FIG. 6.

FIG. 8 is a front elevational view of another alternate embodiment of the invention.

FIG. 9 is a front elevational view of the primary embodiment of the invention.

FIG. 10 is a front elevational view of an embodiment similar to FIG. 9 but with a removable component.

FIG. 16 is a perspective illustration of the final alternative embodiment of the invention.

FIG. 17 is a cross sectional view taken along line 17-17 of FIG. 16.

FIG. 18 is a perspective illustration of the connector shown in FIGS. 16 and 17.

FIGS. 19 and 20 are views similar to FIGS. 17 and 18 but illustrating an enlarged version thereof.

The same reference numerals refer to the same parts throughout the various Figures.

DESCRIPTION OF THE PREFERRED EMBODIMENT

Figure 1:
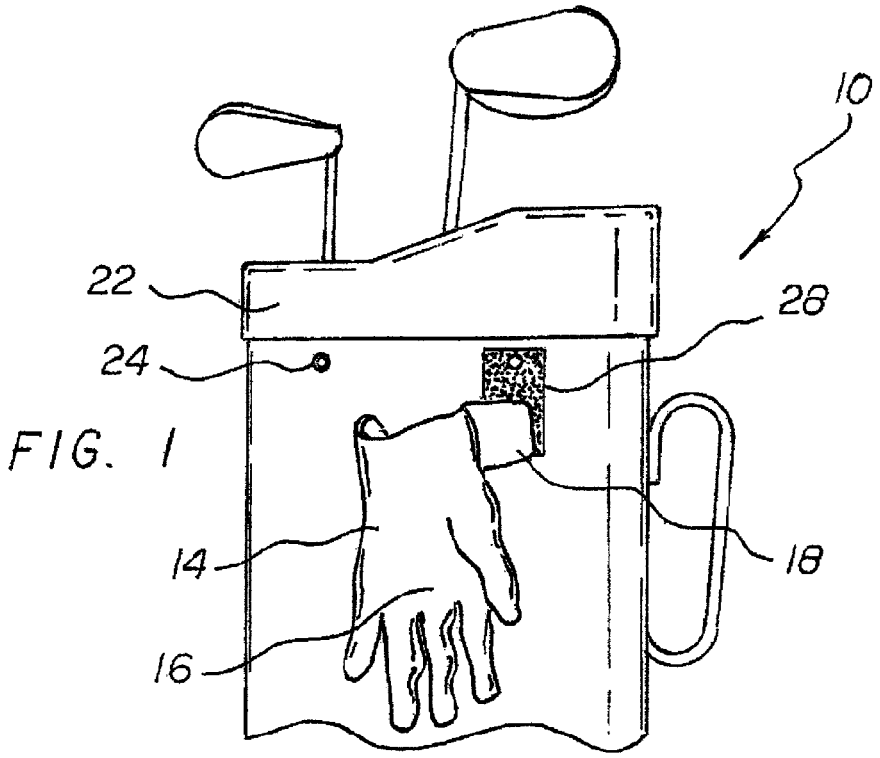
FIG. 1 is a perspective illustration of a grip-it golf glove system constructed in accordance with the principles of the present invention.

With reference now to the drawings, and in particular to FIG. 1 thereof, the embodiments of the new and improved grip-it golf method and system embodying the principles and concepts of the present invention and generally designated by the reference numeral 10 will be described.

The present invention, the grip-it golf method and system 10 is comprised of a plurality of steps and components. Such steps and components in their broadest context include a flexible connector, a fastener and a patch of a hook and loop fastener. Such components are individually configured and correlated with respect to each other so as to attain the desired objective.

First provided is a golf glove 14. The golf glove has a hand covering section 16. The hand covering section is positionable over the fingers and palm of a wearer. The golf glove has a strap section 18. The strap section is positionable adjacent to a wrist of the wearer.

A golf bag 22 is provided. The golf bag has an upper peripheral area. The upper peripheral area has a plurality of male snap fasteners 24. The male snap fasteners project outwardly from the upper peripheral area.

A rectangular connector 28 is provided next. The connector has a linear top edge 30. The connector has a parallel linear bottom edge 32. The top and bottom edges are separated by a length of between 5 and 7 inches. The connector has linear parallel side edges 34. The side edges are separated by a width of between 2 and 4 inches. The connector has an upper surface 36. The connector has a parallel lower surface 38. The upper and lower surfaces separated by a thickness. The connector is fabricated of a flexible, essentially inextensible fabric.

Further provided is a first female snap fastener 42. The first female snap fastener extends from the upper surface adjacent to the top edge. A second female snap fastener 44 is provided. The second female snap fastener extends from the lower surface adjacent to the bottom edge. One of the female snap fasteners is releasably coupled to one of the male snap fastener. In this manner the connector will hang from a user-selected area of the golf bag.

Provided last is a first patch 48 of a hook and loop fastener. The first patch is secured to the first surface of the connector. The first patch is of a hook orientation. A second patch 50 of a hook and loop fastener is provided. The second patch is secured to the second surface of the connector. The second patch is of a loop orientation. A third patch 52 of a hook and loop fastener is provided. The third patch is secured to the strap of the glove. The third patch is adapted to releasably couple to a preselected one of the patches of the connector.

Figure 3:
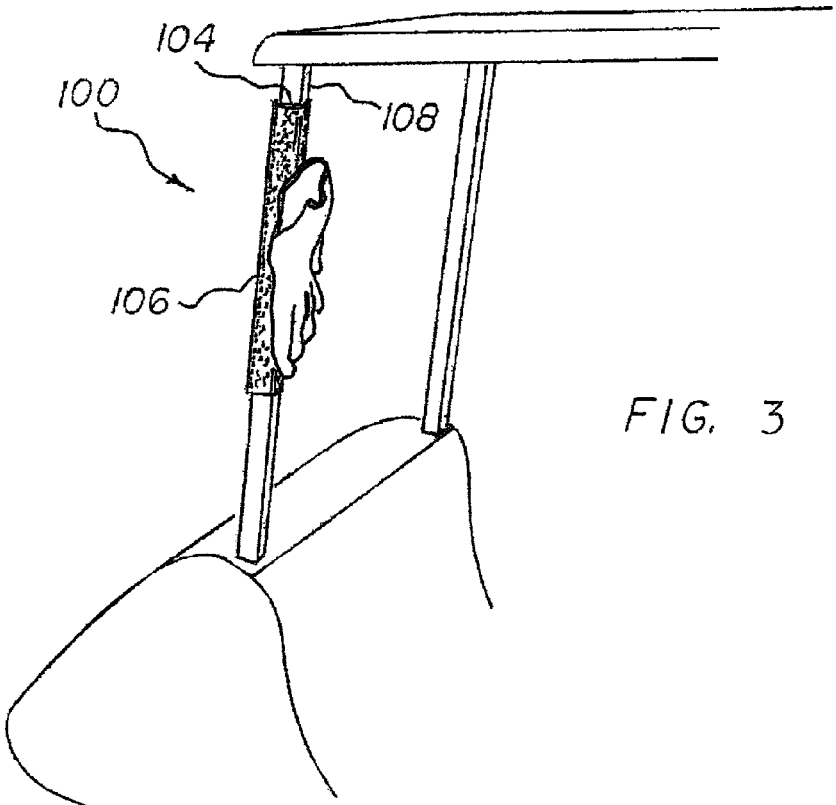

An alternate embodiment 100 of the present invention is provided. The fastener is an adhesive 104. A connector 106 is provided. The fastener is provided on the lower surface of the connector and the recipient surface. The recipient surface is a support post 108 of a golf cart. Note FIG. 3.

Figure 4:
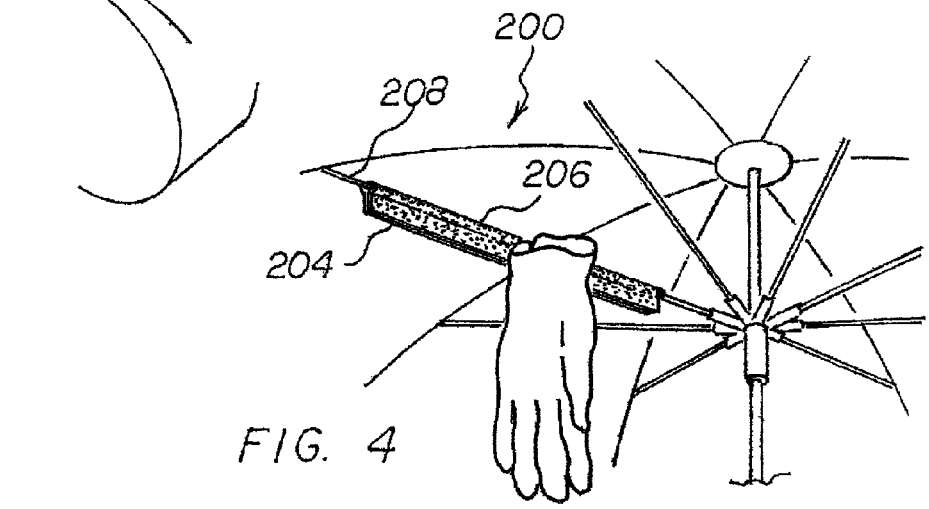

Another alternate embodiment 200 of the present invention is provided. The fastener is an adhesive 204. A connector 206 is provided. The adhesive is provided on the lower surface of the connector and the recipient surface. The recipient surface is a rib 208 of an umbrella. Note FIG. 4.

Another alternate embodiment 300 of the present invention is provided. The fastener is an adhesive 304. A connector 306 is provided. The adhesive is provided on the lower surface of the connector and the recipient surface. The recipient surface is a towel rack 308. Note FIG. 8.

An alternate embodiment 400 of the present invention is provided. The fastener is stitching 404. A connector 406 is provided. The stitching is provided through the connector adjacent the periphery and the recipient surface. The recipient surface is trousers 408. The system includes a supplemental connector 410. The connector and the supplemental connector have a hook fastener and a loop fastener respectively. Note FIGS. 6 and 7.

Another embodiment of the invention is a grip-it golf system for releasably supporting a golf glove and for maintaining the golf glove in a readily accessible location. The supporting and the maintaining are done in a safe, convenient and economical manner. The system comprises the following steps.

The first step in the method is providing a golf glove having a hand covering section positionable over the fingers and palm of a golfer, the golf glove having a strap section positionable adjacent to a wrist of the golfer.

The next step is providing trousers for being worn by the golfer, the trousers having an upper waist band area and rear left and right pockets there beneath, the trousers having left and right attachment zones above the left and right pockets beneath the upper waist band area.

The next step is providing two similarly configured primary connectors, the primary connectors each being rectangular with a linear top edge and a parallel linear bottom edge separated by a height of from one inch to two inches, the primary connectors each having linear parallel side edges separated by a width of from four inches to eight inches, the primary connectors each having an exposed upper surface and a parallel lower surface separated by a thickness, the primary connectors each being fabricated of a flexible, essentially inextensible fabric with a hook and loop fastener on the exposed upper surface.

The next step is stitching the primary connectors to the trousers by stitches extending through the trousers in the left and right attachment zones and through the primary connectors adjacent the top and bottom and side edges.

The next step is providing a supplemental connector being fabricated of a flexible, essentially inextensible, fabric and having a hook and loop fastener.

The next step is stitching the supplemental connector to the golf glove by stitches extending through the golf glove and through the supplemental connector for releasably coupling the golf glove with respect to the trousers in a location to cover one of the rear left and right pockets.

The final step of this embodiment of the method is providing a yardage book removably positioned in one of the pockets, the yardage book being covered by the golf glove when the golfer utilizing the system is on a putting green and is not wearing the golf glove, the yardage book being uncovered and accessible by the golfer when the golfer utilizing the system is on a fairway and wearing the golf glove.

An alternate embodiment of the grip-it golf system (500) is illustrated in FIG. 9 and functions for releasably supporting a golf glove 14 and for maintaining the golf glove in a readily accessible location. The supporting and the maintaining are done in a safe, convenient, and economical manner.

In this alternate embodiment, the system includes a golf glove 14 having a hand covering section 16 positionable over the fingers and palm of a golfer. The golf glove also has a strap section 18 positionable adjacent to a wrist of the golfer.

The system also includes a golf bag.

Next provided is a primary connector 512. The primary connector is rectangular with a linear top edge 514 and a parallel linear bottom edge 516 separated by a height. The primary connector has linear parallel side edges 518, 520 separated by a width. The primary connector has a height of from 5 inches to 7 inches and a width of from 2 inches to 4 inches. The primary connector has an upper surface 522 and a parallel lower surface 524 separated by a thickness. The primary connector is fabricated of a flexible, essentially inextensible fabric. The primary connector has a first face having a male hook and loop fastener 526. The primary connector has a second face having a female hook and loop fastener 528.

A mechanical connector 532 couples the primary connector to the golf bag. The mechanical connector includes four snap fasteners, one snap fastener on each surface adjacent to the top edge and the bottom edge.

Lastly provided in this embodiment is a supplemental connector 534 attached to the golf glove. The supplemental connector is fabricated of a flexible, essentially inextensible fabric with a male hook and loop fastener. The supplemental connector has an identifiable peripheral shape 536 such as a corporate identifier. The primary connector includes an identifiable area 538 with a peripheral shape the same as the identifiable peripheral shape of the supplemental connector.

FIG. 10 illustrates an embodiment similar to the embodiment of FIG. 9. In such system (600), the primary connector (604) includes a removable component (606). The removable component is formed an identifiable peripheral shape such as a corporate identifier. Such shape corresponds in shape to the shape of the supplemental connector.

Figure 11:
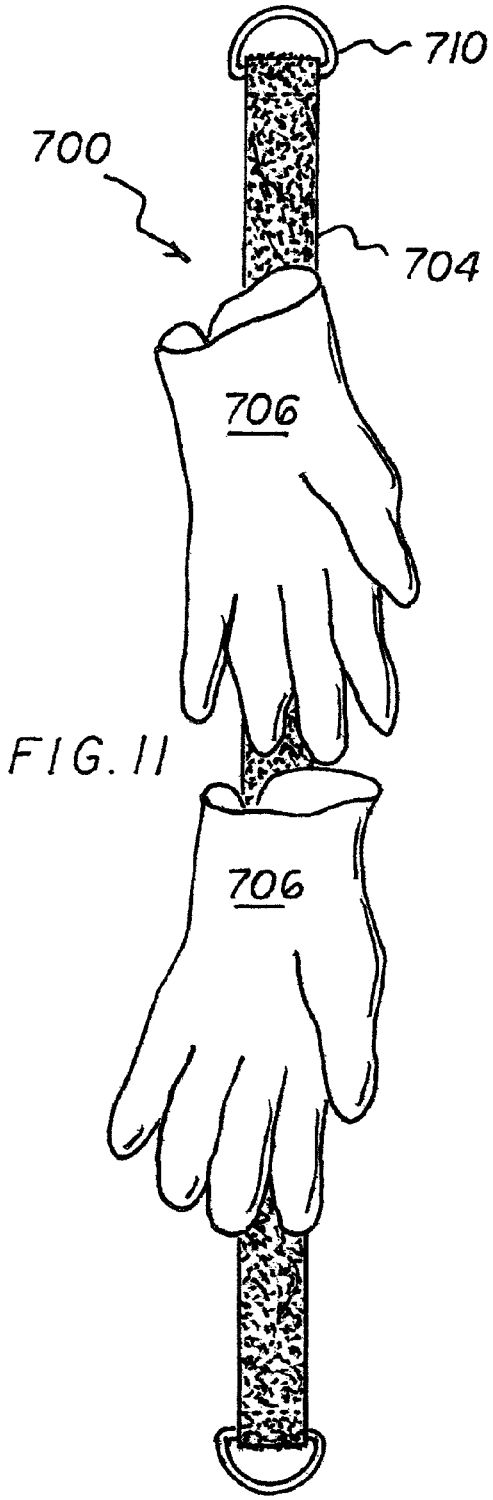
FIGS. 11 and 12 are front and side elevational views of another embodiment of the invention.
Figure 12:
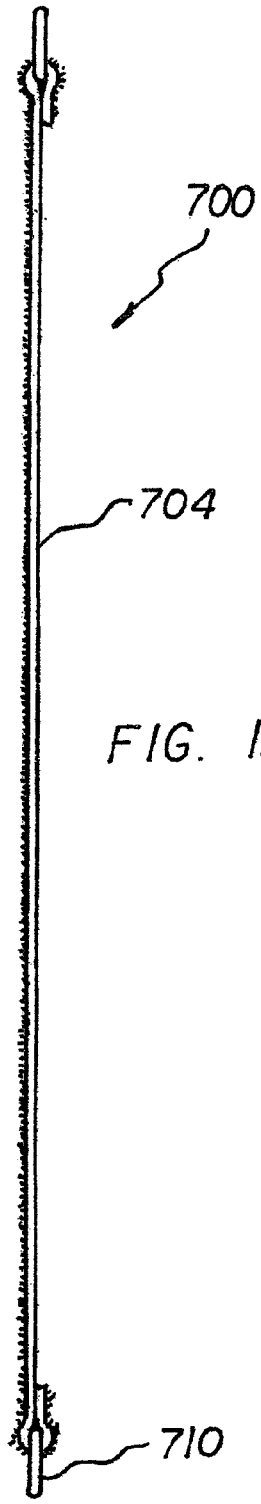

The next embodiment is illustrated in FIGS. 11 and 12. Such system (700) utilizes a primary connector (704) which has a height of from 20 inches to 28 inches and a width of from 1 inch to 3 inches. Such a configuration is for receiving and removably supporting a plurality of golf gloves (706). The preferred mechanical connectors are D-rings (710) for coupling to any of a wide variety of recipient members.

Another embodiment of the invention is illustrated in FIGS. 16 through 20. Such embodiment is similar to the embodiment of FIG. 3. More particularly, the final embodiment is a grip-it golf method 900 for releasably supporting a golf glove 904 and for maintaining the golf glove in a readily accessible location. The supporting and the maintaining are done in a safe, convenient, and economical manner. The method comprises, in combination, the steps of first providing the golf glove 904. The golf glove has a hand covering section 906 positionable over the fingers and palm of a golfer. The golf glove has a strap section positionable adjacent to a wrist of the golfer. The strap portion has an interior component 908 of a male hook fastener. The strap portion has an exterior component 910 of a female loop fastener.

The next step is providing a supporting member in the form of a golf cart with an essentially vertical forward roof support post 914, wherein the essentially vertical forward roof support post has a square cross sectional configuration with a forward face and a rearward face and a left side face and a right side face. Each face of the essentially vertical forward roof support post has a width of from 1.00 inches to 1.25 inches and a height greater than 11 inches, preferably of from 12 inches to 14 inches.

The next step is providing a connector 918 having a width of from 2.5 inches to 3.5 inches and a height from 9 inches to 11 inches. The connector laterally covers the entire rearward face of the essentially vertical forward roof support post and laterally covers a majority of each side face of the essentially vertical forward roof support post and covers none of the forward face of the essentially vertical forward roof support post laterally does not cover a minority of each side face of the essentially vertical forward roof support post.

The next step is providing an adhesive 922 on the interior surface of the connector for coupling the connector to the essentially vertical forward roof support post.

The final step of this embodiment of the method is releasably coupling the female loop fastener of the glove to the male hook fastener of the connector so that the weight of the connector will hold the glove against the golf bag elevationally beneath the coupled male and female snaps for securement purposes and for drying when the golf bag and connector and golf glove are moving as on a golf cart.

The height of the connector is from 9.5 inches and 10.5 inches. The width of the connector in a first size is 2.5 inches plus or minus 10 percent. Note FIGS. 17 and 18. The width of the connector in a second size is 3.5 inches plus or minus 10 percent. Note FIGS. 19 and 20. The width of the connector is from 25 percent to 35 percent of the height of the connector.

Figure 2:
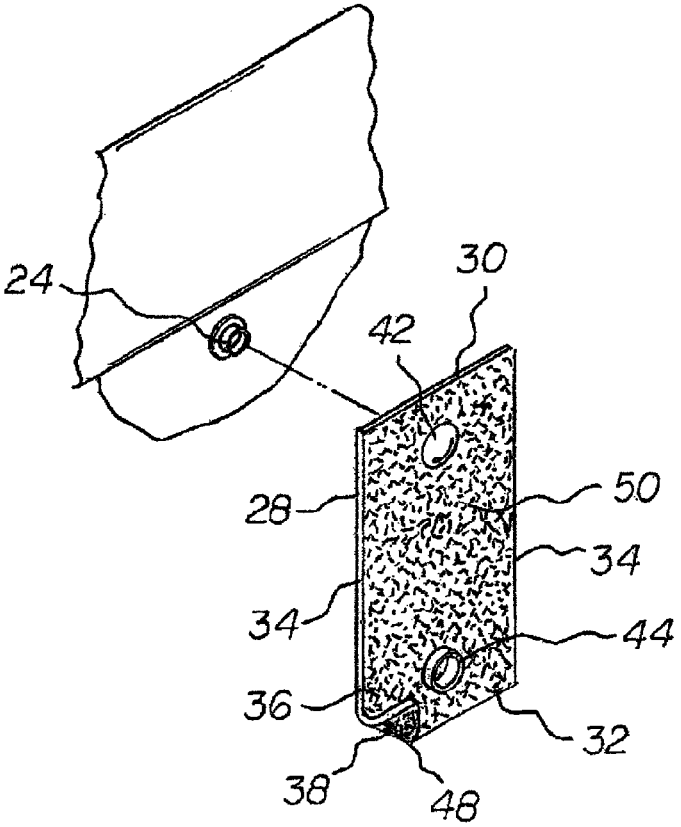
FIG. 2 is an exploded perspective illustration of a portion of the system shown in FIG. 1.
Figure 13:
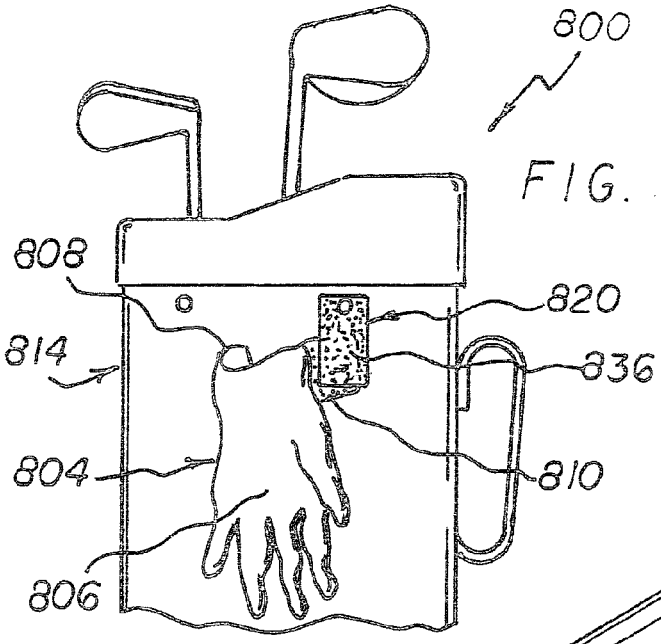
FIGS. 13, 14 and 15 are a front elevational view, a perspective illustration and a rear elevational view of another alternate embodiment of the invention.
Figure 14:
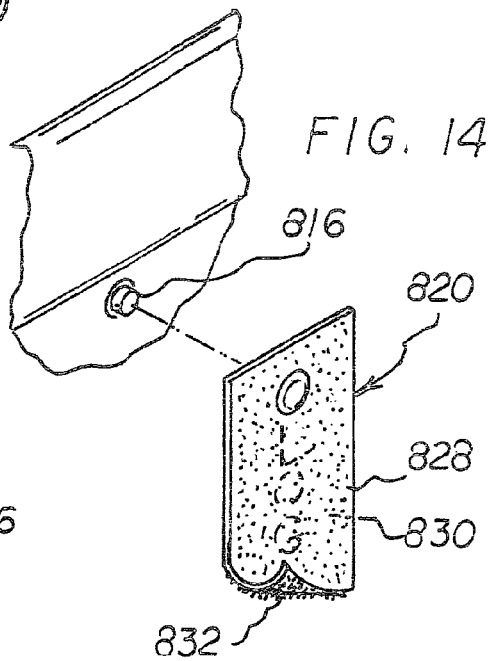
Figure 15:
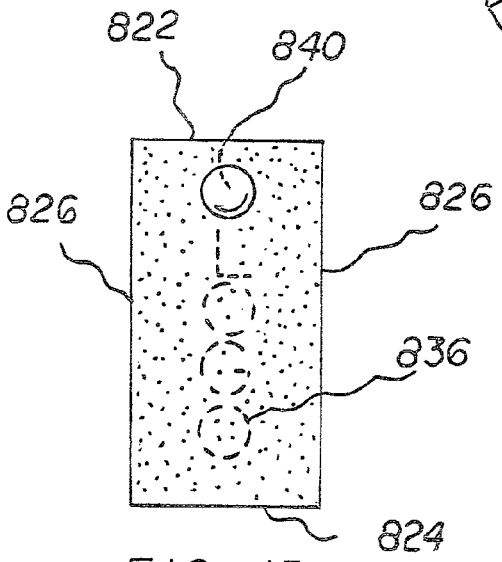

The final, and preferred embodiment of the invention is illustrated in FIGS. 13 through 15. Such embodiment is similar to the embodiment of FIGS. 1 and 2. More particularly, this embodiment is a grip-it golf method and system 800 for releasably supporting a golf glove 804 and for maintaining the golf glove in a readily accessible location. The supporting and the maintaining are done in a safe, convenient and economical manner.

First provided in the final preferred system 800 is a golf glove 804. The golf glove has a hand covering section 806 positionable over the fingers and palm of a golfer. The golf glove has a strap section positionable adjacent to a wrist of the golfer. The strap portion has an interior component 808 of a male hook fastener. The strap portion has an exterior component 810 of a female loop fastener.

Next provided is a supporting member in the form of a golf bag 814. The golf bag has a closed bottom and an open top. The golf bag has a side wall between the closed bottom and the open top. The side wall includes a male snap 816 adjacent to the top.

Next provided is a connector 820. The connector is rectangular with a linear top edge 822 and a parallel linear bottom edge 824 separated by a height of between 5 and 7 inches. The connector has linear parallel side edges 826 separated by a width of between 2 and 4 inches. The width is between 40 and 60 percent of the height. The size of the connector makes it capable of receiving and supporting a plurality of golf gloves. The connector has an exposed exterior surface 828 and a parallel interior surface 830 separated by a thickness. The connector is fabricated of a flexible, essentially inextensible fabric with a male hook fastener 832 on the interior surface.

Finally a female snap 840 is provided on the interior surface of the connector for releasably coupling the connector directly to the male snap of the golf bag is the next step. The female snap of the connector is coupled to the male snap of the golf bag and the female loop fastener of the glove is coupled to the male hook fastener of the connector. In this manner, the weight of the connector will hold the glove against the golf bag elevationally beneath the coupled male and female snaps for securement purposes. Further, air drying of the supported golf glove will take place when the golf bag and connector and golf glove are moving as on a golf cart.

The final and preferred method comprises, in combination, the steps of first providing the golf glove 804. The golf glove has a hand covering section 806 positionable over the fingers and palm of a golfer. The golf glove has a strap section positionable adjacent to a wrist of the golfer. The strap portion has an interior component 808 of a male hook fastener. The strap portion has an exterior component 810 of a female loop fastener.

The second step is providing a supporting member in the form of a golf bag 814. The golf bag has a closed bottom and an open top. The golf bag has a side wall between the closed bottom and the open top. The side wall includes a male snap 816 adjacent to the top.

The third step is providing a connector 820. The connector is rectangular with a linear top edge 822 and a parallel linear bottom edge 824 separated by a height of between 5 and 7 inches. The connector has linear parallel side edges 826 separated by a width of between 2 and 4 inches. The width is between 40 and 60 percent of the height. The size of the connector makes it capable of receiving and supporting a plurality of golf gloves. The connector has an exposed exterior surface 828 and a parallel interior surface 830 separated by a thickness. The connector is fabricated of a flexible, essentially inextensible fabric with a male hook fastener 832 on the interior surface.

Providing a female snap 840 on the interior surface of the connector for releasably coupling the connector directly to the male snap of the golf bag is the next step.

The penultimate step is releasably coupling the female snap of the connector to the male snap of the golf bag.

The final step is releasably coupling the female loop fastener of the glove to the male hook fastener of the connector. In this manner, the weight of the connector will hold the glove against the golf bag elevationally beneath the coupled male and female snaps for securement purposes. Further, air drying of the supported golf glove will take place when the golf bag and connector and golf glove are moving as on a golf cart.

A variation of the above method includes the steps of providing a logo 836 on the exterior surface of the connector. An additional step of the variation of the above method is Providing a male hook fastener 844 on the interior surface of the connector remote from the female snap.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A grip-it golf method (800) for releasably supporting a golf glove (804) and for maintaining the golf glove in a readily accessible location, the supporting and the maintaining being done in a safe, convenient and economical manner, the method comprising, in combination, the steps of:

providing the golf glove (804) having a hand covering section (806) positionable over the fingers and palm of a golfer, the golf glove having a strap section positionable adjacent to a wrist of the golfer, the strap portion having an interior component (808) of a male hook fastener, the strap portion having an exterior component (810) of a female loop fastener;

providing a supporting member in the form of a golf bag (814) with a closed bottom and an open top and a side wall between the bottom and the top, the side wall including a male snap (816) adjacent to the top;

providing a connector (820), the connector being rectangular with a linear top edge (822) and a parallel linear bottom edge (824) separated by a height, the connector having linear parallel side (826) edges separated by a width, the height of the connector being between 5 and 7 inches, the width of the connector being between 2 and 4 inches, the width being between 40 and 60 percent of the height, the size of the connector being capable of receiving and supporting a plurality of golf gloves, the connector having an exposed exterior surface (828) and a parallel interior surface (830)) separated by a thickness, the connector being fabricated of a flexible, essentially inextensible fabric with a male hook fastener (832) on the interior surface;

providing a female snap (840) on the interior surface of the connector for releasably coupling the connector directly to the male snap of the golf bag;

releasably connecting the female snap (840) of the connector directly to the male snap (816) of the golf bag with no intermediate component between the female snap of the connector and the male snap of the golf bag; and releasably connecting the female loop fastener (810) of the glove to the male hook fastener (832) of the connector whereby the weight of the connector will hold the glove against the golf bag elevationally beneath the coupled male and female snaps for securement purposes and for drying when the golf bag and connector and golf glove are moving as on a golf cart.

2. A grip-it golf system (800) for releasably supporting a golf glove (804) and for maintaining the golf glove in a readily accessible location, the supporting and the maintaining being done in a safe, convenient and economical manner, the system comprising, in combination:

the golf glove (804) having a hand covering section (806) positionable over the fingers and palm of a golfer, the golf glove having a strap section positionable adjacent to a wrist of the golfer, the strap portion having an interior component (808) of a male hook fastener, the strap portion having an exterior component (810) of a female loop fastener;

a supporting member in the form of a golf bag (814) with a closed bottom and an open top and a side wall between the bottom and the top, the side wall including a male snap (816) adjacent to the top;

a connector (820), the connector being rectangular with a linear top edge (822) and a parallel linear bottom edge (824) separated by a height, the connector having linear parallel side (826) edges separated by a width, the height of the connector being between 5 and 7 inches, the width of the connector being between 2 and 4 inches, the width being between 40 and 60 percent of the height, the size of the connector being capable of receiving and supporting a plurality of golf gloves, the connector having an exposed exterior surface (828) and a parallel interior surface (830) separated by a thickness, the connector being fabricated of a flexible, essentially inextensible fabric with a male hook fastener (832) on the interior surface; and a female snap (840) on the interior surface of the connector for releasably connecting the connector directly to the male snap of the golf bag with no intermediate component between the female snap of the connector and the male snap of the golf bag whereby the female snap (840) of the connector is connected directly to the male snap (816) of the golf bag and the female loop fastener (810) of the glove is coupled to the male hook fastener (832) of the connector so that the weight of the connector will hold the glove against the golf bag elevationally beneath the coupled male and female snaps for securement purposes and for drying when the golf bag and connector and golf glove are moving as on a golf cart.

3. The method as set forth in claim 1 and further including the step of providing indicia on the connector.

4. The system as set forth in claim 2 and further including indicia (836) on the connector.

* * * * *